US006694932B2

(12) United States Patent
Stull

(10) Patent No.: US 6,694,932 B2
(45) Date of Patent: Feb. 24, 2004

(54) VALVE ASSEMBLY WITH SWINGING VALVE FACE MOVING OUT OF THE FLUID PATH

(76) Inventor: Allen H. Stull, 14963 Nowthen Blvd., Ramsey, MN (US) 55303

( * ) Notice: Subject to any disclaimer, the term of this patent is extended or adjusted under 35 U.S.C. 154(b) by 0 days.

(21) Appl. No.: 09/963,993

(22) Filed: Sep. 26, 2001

(65) Prior Publication Data

US 2003/0056739 A1 Mar. 27, 2003

(51) Int. Cl.[7] ..... F01L 7/00

(52) U.S. Cl. ..... 123/81 D; 123/188.1; 123/81 R

(58) Field of Search ..... 123/81 D, 188.1, 123/81 R, 81 B, 80 DA, 80 R, 190.1, 190.7, 190.9, 190.14, 188.8; 137/615, 616, 616.7, 45, 56, 315.17, 315.22, 315.24, 315.39, 321, 323

(56) References Cited

U.S. PATENT DOCUMENTS

| | | | | | |
|---|---|---|---|---|---|
| 973,800 | A | * | 10/1910 | McKinnon | 123/188.5 |
| 1,075,163 | A | * | 10/1913 | Simpson | 123/81 B |
| 1,083,208 | A | * | 12/1913 | Goodness | 123/81 B |
| 1,397,585 | A | * | 11/1921 | James | 123/79 R |
| 1,599,430 | A | * | 9/1926 | Ofeldt | 123/190.14 |
| 1,639,217 | A | * | 8/1927 | Dufwa | 123/81 B |
| 1,894,546 | A | * | 1/1933 | Simpson | 123/81 B |
| 1,923,666 | A | * | 8/1933 | French | 123/81 D |
| 1,988,018 | A | * | 1/1935 | Peterson | 123/90.44 |
| 2,086,705 | A | * | 7/1937 | Ellis | 123/81 B |
| 2,874,686 | A | * | 2/1959 | Carey, Jr. | 123/190.14 |
| 3,299,869 | A | * | 1/1967 | Sicklesteel | 123/90.27 |
| 3,687,010 | A | * | 8/1972 | Paxton | 91/262 |
| 4,041,837 | A | * | 8/1977 | Weidlich | 91/270 |
| 4,098,238 | A | * | 7/1978 | Vallejos | 123/81 B |
| 4,201,174 | A | * | 5/1980 | Vallejos | 123/188.4 |
| 4,662,323 | A | | 5/1987 | Moriya | |
| 4,776,306 | A | * | 10/1988 | Matsuura et al. | 123/80 R |
| 4,790,272 | A | | 12/1988 | Woolenweber | |
| 4,805,568 | A | | 2/1989 | Springer et al. | |
| 4,864,984 | A | * | 9/1989 | Blish | 123/190.2 |
| 4,969,918 | A | * | 11/1990 | Taniguchi | 123/190.2 |
| 5,392,743 | A | * | 2/1995 | Dokonal | 123/190.8 |
| 5,410,996 | A | * | 5/1995 | Baird | 123/190.2 |
| 5,740,771 | A | * | 4/1998 | Sebastian | 123/188.4 |
| 6,382,146 | B2 | * | 5/2002 | Lamp | 123/81 B |

* cited by examiner

*Primary Examiner*—Henry C. Yuen
*Assistant Examiner*—Hai Huynh
(74) *Attorney, Agent, or Firm*—Alan D. Kamrath; Rider Bennett, LLP

(57) ABSTRACT

A valve assembly for limiting the flow of fluid into and out of a chamber, consisting of: a valve seat in a wall of the chamber, wherein fluid flows into and out of the chamber through the valve seat; a valve face engaging the valve seat, wherein the valve face is external to the chamber; and a mechanism for moving the valve face toward and away from the valve seat wherein the valve face is substantially removed from the path of fluid flow through the valve seat when the valve face is moved away from the valve seat.

21 Claims, 7 Drawing Sheets

VALVE ASSEMBLY WITH SWINGING VALVE FACE MOVING OUT OF THE FLUID PATH

BACKGROUND OF THE INVENTION

The present invention relates to a valve assembly that allows the valve face to swing away from the valve seat and out of the way of the path of flow of fluid through the valve.

In any type of mechanical device that requires the process of controlling the flow of a fluid entering and exiting a chamber to generate energy, as in a motor, or to transfer fluids, as in a compressor or pump, the passage of fluid is controlled by valves.

The most common type of valve in these apparata is the poppet valve, which has a valve face that moves linearly toward and away from a valve seat. The result is that the valve face is always to some extent in the path of fluid flow. When the valve opens, the flow of fluid over the valve face creates a vortex just under the valve face, creating a pocket. This pocket becomes a void of a fresh mixture of fluid, and an area that does not generate energy. The result is that a richer mixture is required to offset this void and still generate a given amount of energy per an established displacement.

Because the valve face of the poppet valve is always to some extent in the path of fluid, it also acts as an obstruction to fluid flow. Therefore, some applications such as an internal combustion engine currently require two valves to allow a given amount of fluid flow and/or larger valves.

U.S. Pat. No. 4,805,568 discloses a swing valve for internal combustion engines in which the valve swings slightly away from its longitudinal axis during each reciprocation. However, it appears that the valve still remains substantially in the path of fluid flow even when swung away from its longitudinal axis.

U.S. Pat. No. 4,790,272 discloses a valve assembly including one or more valve openings and valves having a non-circular periphery that the patent discloses as increasing the air quantity available in the cylinder assembly for combustion. However, the valve appears to remain substantially in the path of fluid flow.

Because of the configuration of poppet valves, current manufacturing methods require the valve seat to be cast into the chamber head. This increases the cost of manufacture.

In most current applications, the chamber head has a domed area to accommodate the poppet valve. This in turn requires a piston reciprocating in the chamber to also be convexly domed.

SUMMARY OF THE INVENTION

A valve assembly for limiting the flow of fluid into and out of a chamber, comprising: a valve seat in a wall of the chamber, wherein fluid flows into and out of the chamber through the valve seat; a valve face engaging the valve seat, wherein the valve face is external to the chamber; and means for moving the valve face toward and away from the valve seat wherein the valve face is substantially removed from the path of fluid flow through the valve seat when the valve face is moved away from the valve seat.

It is an object of the present invention to overcome the deficiencies of poppet valves by providing a valve face that swings away from the valve seat in such a manner that the valve face is substantially out of the path of flow of fluid through the valve seat.

It is another object and advantage of the present invention to provide a valve face that does not create turbulence in the chamber immediately below the valve seat. As a result, a smaller amount of fresh fluid needs to be drawn into the chamber to accomplish the same amount of energy output per a given displacement. This in turn results in an improved efficiency in use and energy output for the same amount of fluid that is used.

It is another object and advantage of the present invention to provide a valve face that does not obstruct the flow of fluid through the valve seat.

It is another object and advantage of the present invention to create a larger opening through the valve seat for fluid passage by providing a valve face that swings substantially out of the path of fluid through the valve seat. This may result in the need for smaller valve seats and/or fewer valves for the same amount of fluid.

It is another object and advantage of the present invention to provide a valve seat that does not need to be cast into the chamber head, resulting in reduced manufacturing costs. This also offers the flexibility to manufacture the head in a number of ways, through straight die casting versus sand casting, or a general machine method using a machining center.

It is another object and advantage of the present invention to provide a valve seat that allows the chamber head to be manufactured without a domed area. This reduces manufacturing costs. The domed portion of the chamber can now be built into the piston that is used. In fact, the piston can be reverse domed (concavely). This creates a configuration in which the force is generated in the center of the piston and all of the energy is directed to push the piston down, which would relate to an improved efficiency in use and energy output for the same amount of fluid that is used.

DETAILED DESCRIPTION OF THE PREFERRED EMBODIMENT

Although the invention will be described herein primarily as embodied in an internal combustion engine, it should be recognized that the valve assembly can be used in any application that requires a valve assembly to limit the flow of a fluid into and out of a chamber, such as a compressor or a pump.

Figure 1:
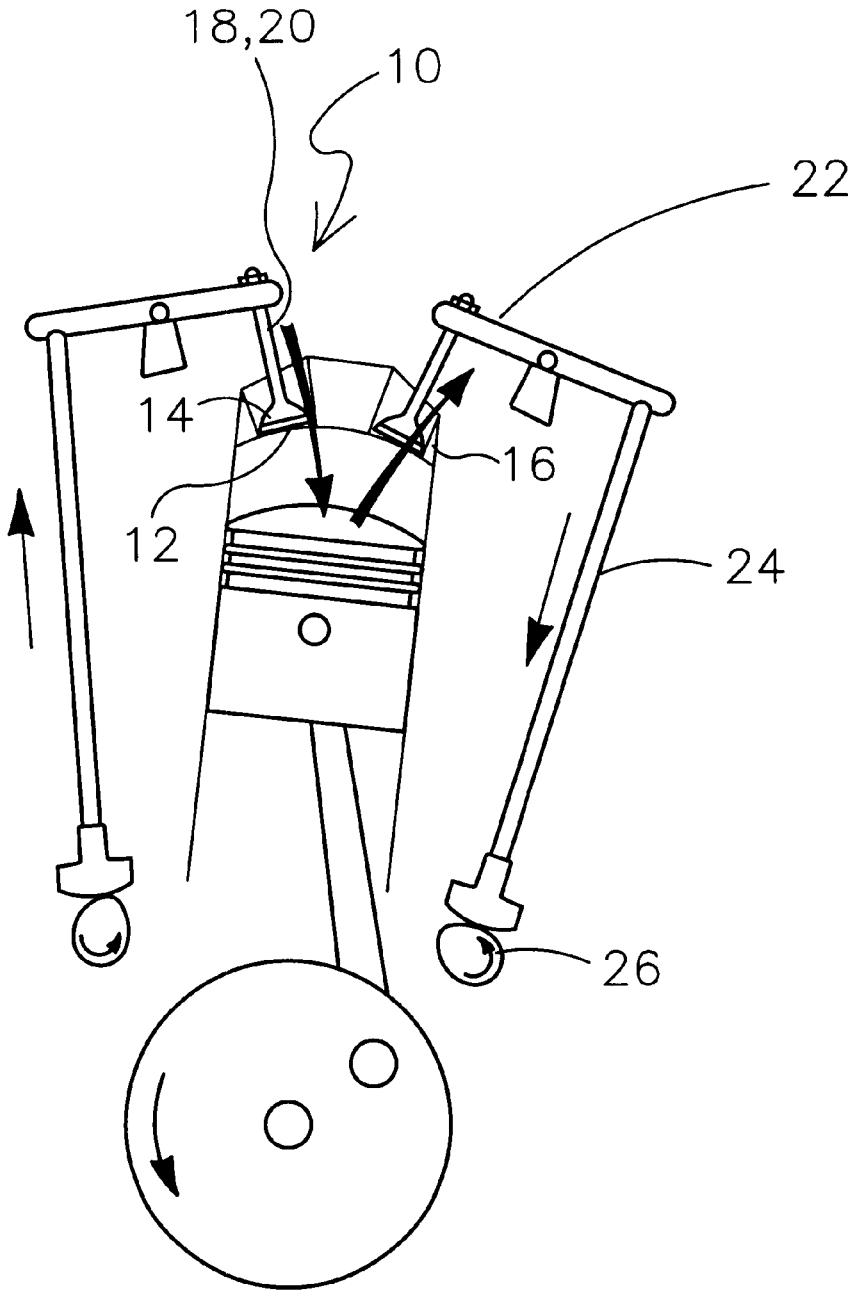
FIG. 1 PRIOR ART
FIG. 1 is a schematic of an engine crankshaft, camshaft, piston, lifters, push rods, rocker arms, cylinder, and valves of the prior art.
Figure 2:
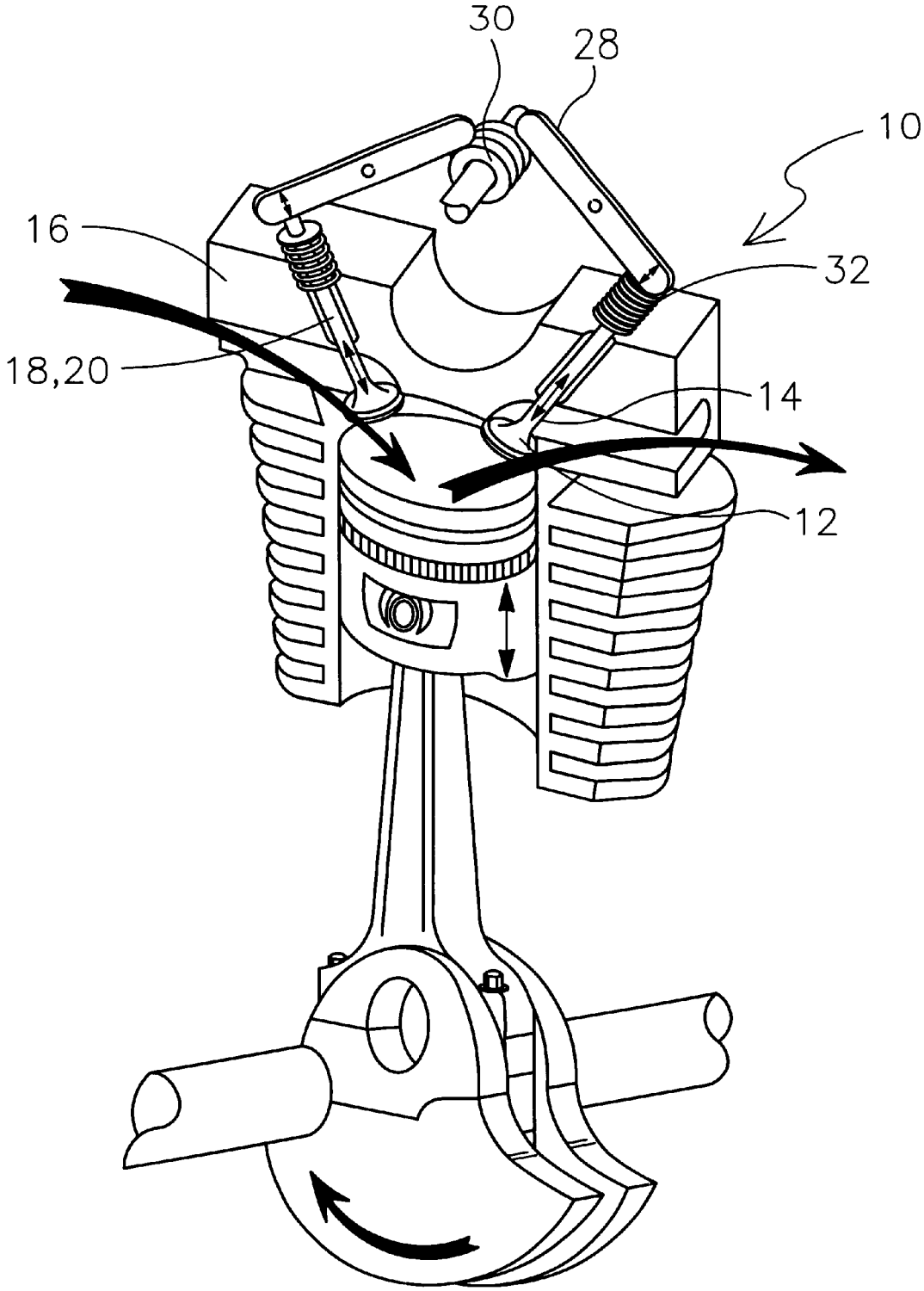
FIG. 2 PRIOR ART
FIG. 2 is similar to FIG. 1, but showing the arrangement for an overhead cam engine.

FIGS. 1 and 2 illustrate part of an internal combustion engine with a valve assembly of the prior art. The valve assembly 10 consists of a valve seat 12 and a valve face 14 that engages the valve seat 12 to limit the flow of either intake air or exhaust gases through the valve seat 12. The valve seat 12 is in the cylinder head 16. The valve face 14 is always internal to the cylinder head. The valve face 14 moves linearly along its axis toward and away from the valve seat 12.

In the prior art embodiments in FIGS. 1 and 2, the valve face 14 is part of a poppet valve 18 with stem 20.

In the embodiment of FIG. 1, the poppet valve 18 is driven toward and away from the valve seat 12 by a system consisting of a rocker arm 22 that is driven by a moving push rod 24 which is in turn driven by a cam 26.

In the embodiment of FIG. 2 (an overhead cam engine), the poppet valve 18 is driven toward and away from the valve seat 12 by a system consisting of a rocker arm 28 that is in turn driven by a cam 30.

In both FIGS. 1 and 2, springs 32 (not shown in FIG. 1) oppose the motion of the poppet valve 18 toward the valve seat 12.

the prior art shown in FIGS. 1 and 2, the poppet valve 18, even when moved away from the valve seat 12, is substantially in the path of fluid flow, shown by the arrows in the FIGS. This is primarily because the valve faces 14 are always inside the cylinder head 16 and move linearly toward and away from the valve seats 12.

Because the poppet valves 18 are always to some extent in the path of fluid flow ("fluid" includes air and exhaust gases), the poppet valve 18 acts as an obstruction to fluid flow. This causes a vortex just under the valve face 14, creating a pocket. The pocket becomes a void of a fresh mixture of fluid and an area that does not generate energy. The result is that a richer mixture is required to offset this void and still generate a given amount of energy per an established displacement. Also, either larger valve seats 12 or multiple intake and exhaust valves 18 may be needed.

Figure 3:
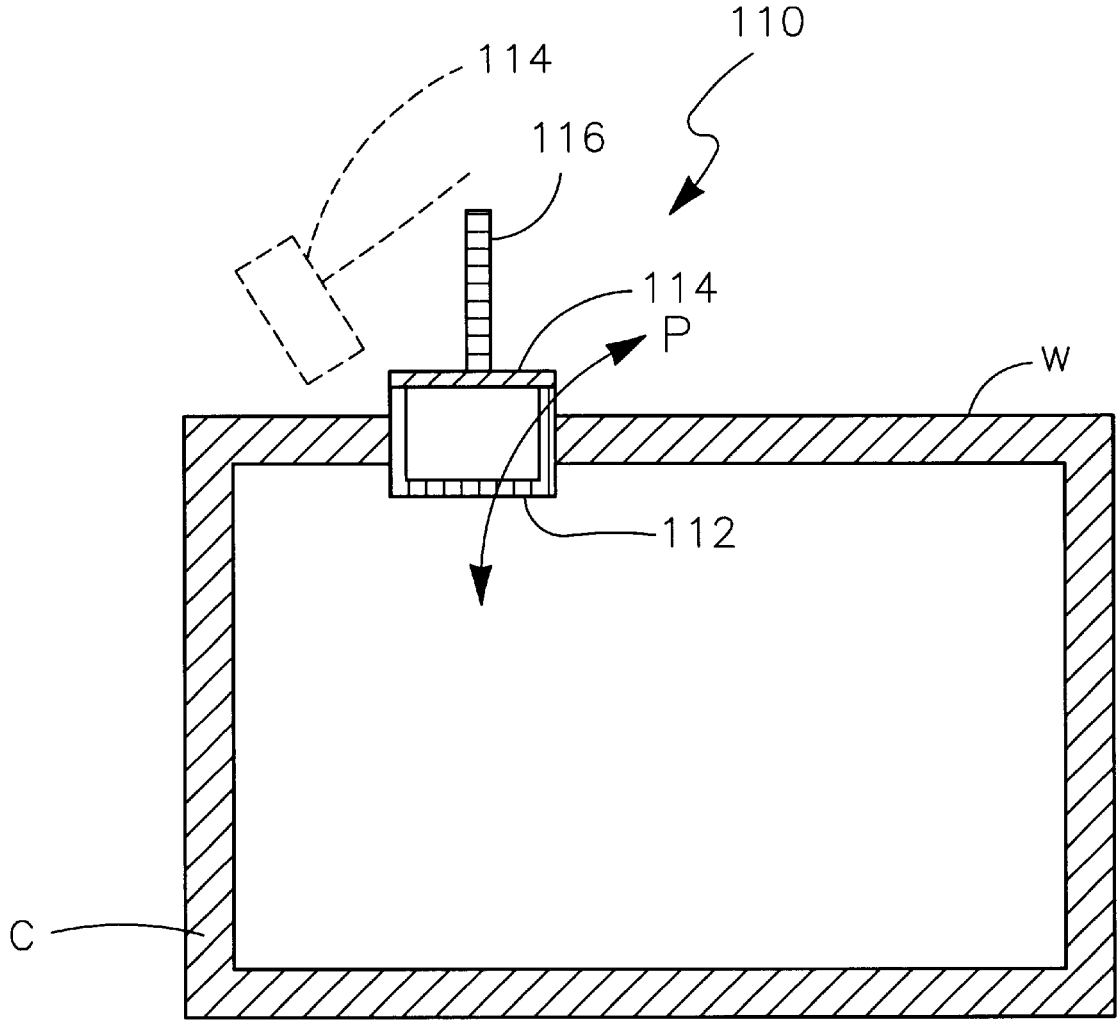
FIG. 3 is a schematic of the general case of the valve assembly of the present invention.

In one aspect, shown in FIG. 3, the present invention comprises a valve assembly 110 for limiting the flow of fluid into and out of a chamber C. The valve assembly 110 comprises a valve seat 112 in a wall W of the chamber C, fluid flowing into and out of the chamber C through the valve seat 112. The valve assembly 110 also comprises a valve face 114 engaging the valve seat 112, wherein the valve face 114 is external to the chamber C. The valve assembly 110 also comprises a means 116 for moving the valve face 114 toward and away from the valve face 112, wherein the valve face 114 is substantially removed from the path P of fluid flow through the valve seat 112 when the valve face 114 is moved away from the valve seat 112.

Figure 4:
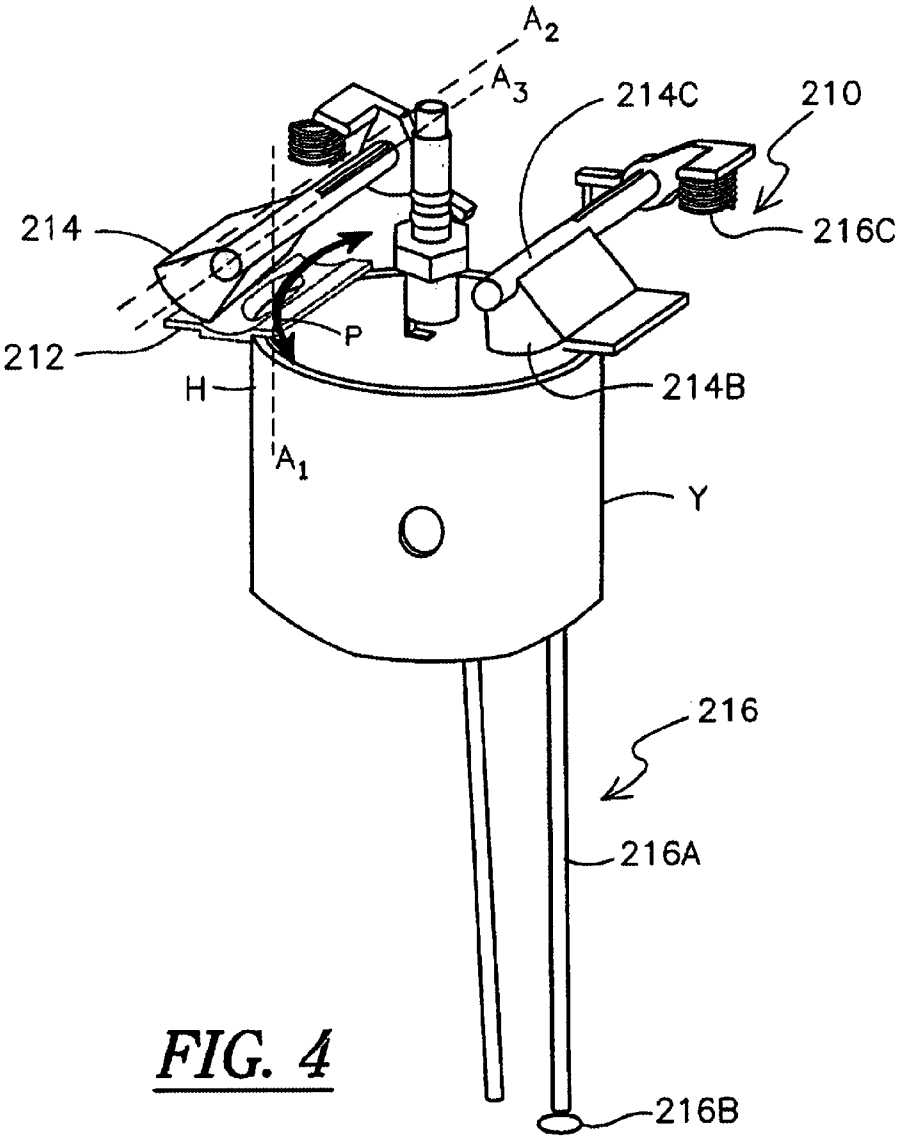
FIG. 4 is a schematic of a cylinder, push rods, camshaft, and valve assembly of the present invention in perspective.
Figure 5:
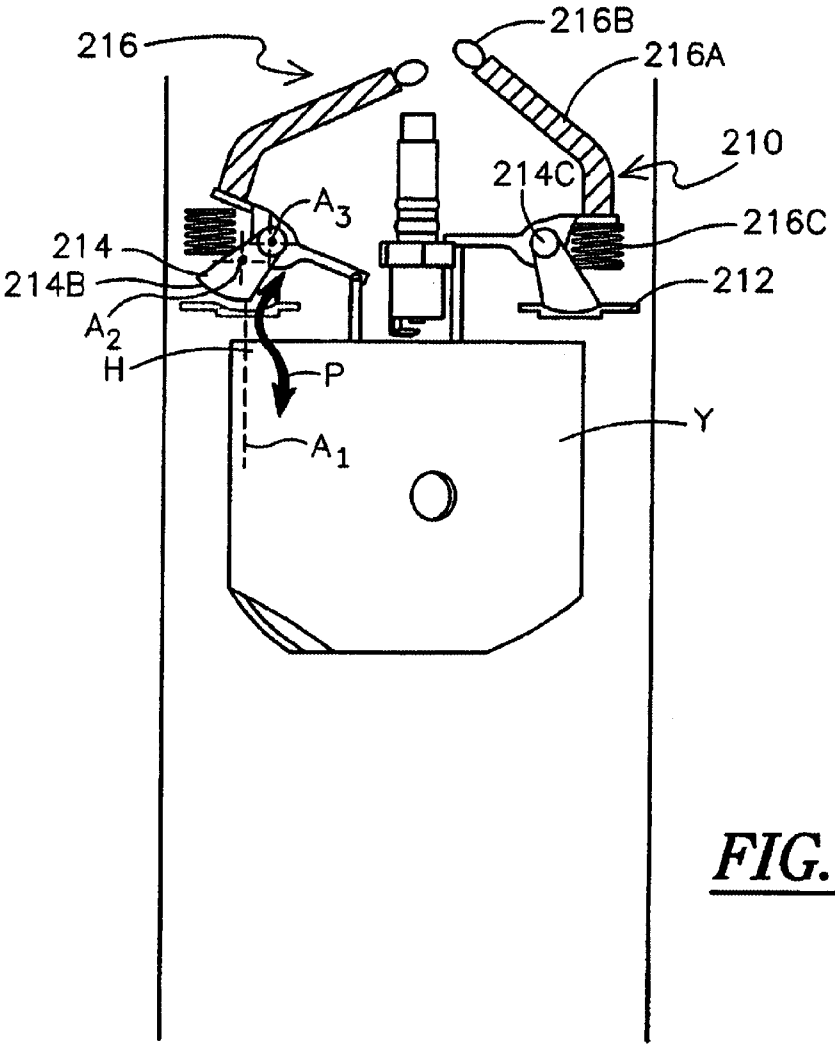
FIG. 5 is a schematic elevational view of a cylinder, rocker arms, camshaft, and valve assembly of the present invention.

In a second aspect shown in FIGS. 4 and 5, the present invention comprises a valve assembly 210 for an internal combustion engine, the engine having a cylinder Y with a cylinder head H, air entering into the cylinder Y through the valve assembly 210 and exhaust gases exiting the cylinder Y through the valve assembly 210. It should be recognized that the valve assembly 210 can be used for either intake of air or output of exhaust gases.

The valve assembly 210 comprises a valve seat 212 in the cylinder head H; a valve face 214 engaging the valve seat 12; and a means 216 for moving the valve face 214 toward and away from the valve seat 212, wherein the valve face 214 is substantially removed from the path P of air and exhaust gas flow through the valve seat 212 when the valve face 214 is moved away from the valve seat 212.

In the embodiment shown in FIG. 4, the means 216 for moving the valve face 214 comprises a moving push rod 216A connected to a camshaft 216B and a spring 216C engaging the valve assembly 210 and opposing motion of the push rod 216A.

In the embodiment shown in FIG. 5 (an overhead cam engine), the means 216 for moving the valve face 214 comprises rocker arm 216A connected to a camshaft 216B and a spring 216C opposing the motion of the rocker arm 216A.

In both embodiments, preferably the valve seat 212 has a first axis A1 therethrough, the valve face 214 has a second axis A2 therethrough, and the valve face 214 rotates about an axis of rotation A3 to move the second axis A2 toward and away from the first axis A1.

Figure 6:
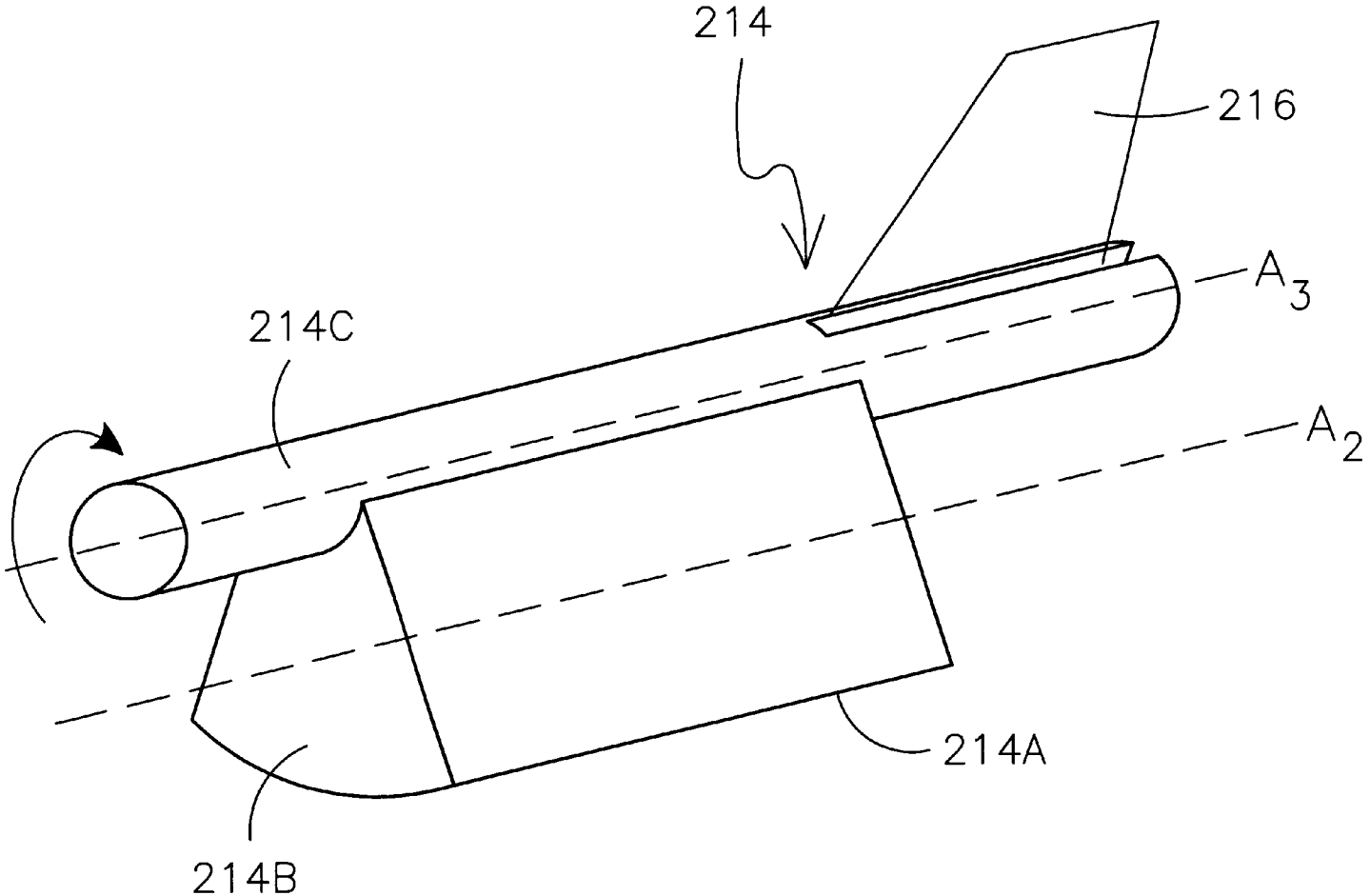
FIG. 6 is a detailed schematic perspective of the valve seat of the present invention.

Preferred details of the valve face 214 are shown in FIG. 6. The valve face 214 further comprises a wedge-shaped portion 214B having an arcuate portion 214A having the second axis A2 located substantially normal to the first axis A1, wherein the arcuate portion 214A engages the valve seat 212.

The valve face 214 may also preferably comprise an elongate portion 214C attached to the wedge-shaped portion 214B opposite the arcuate portion 214A and parallel to the second axis A2 and wherein the means 216 for moving the valve face 214 engages the elongate portion 214C and pauses rotation of the elongate portion 214C about the axis A3 therethrough.

In both embodiments, it will be seen that the valve face 214 is external to the cylinder head Y.

Figure 7:
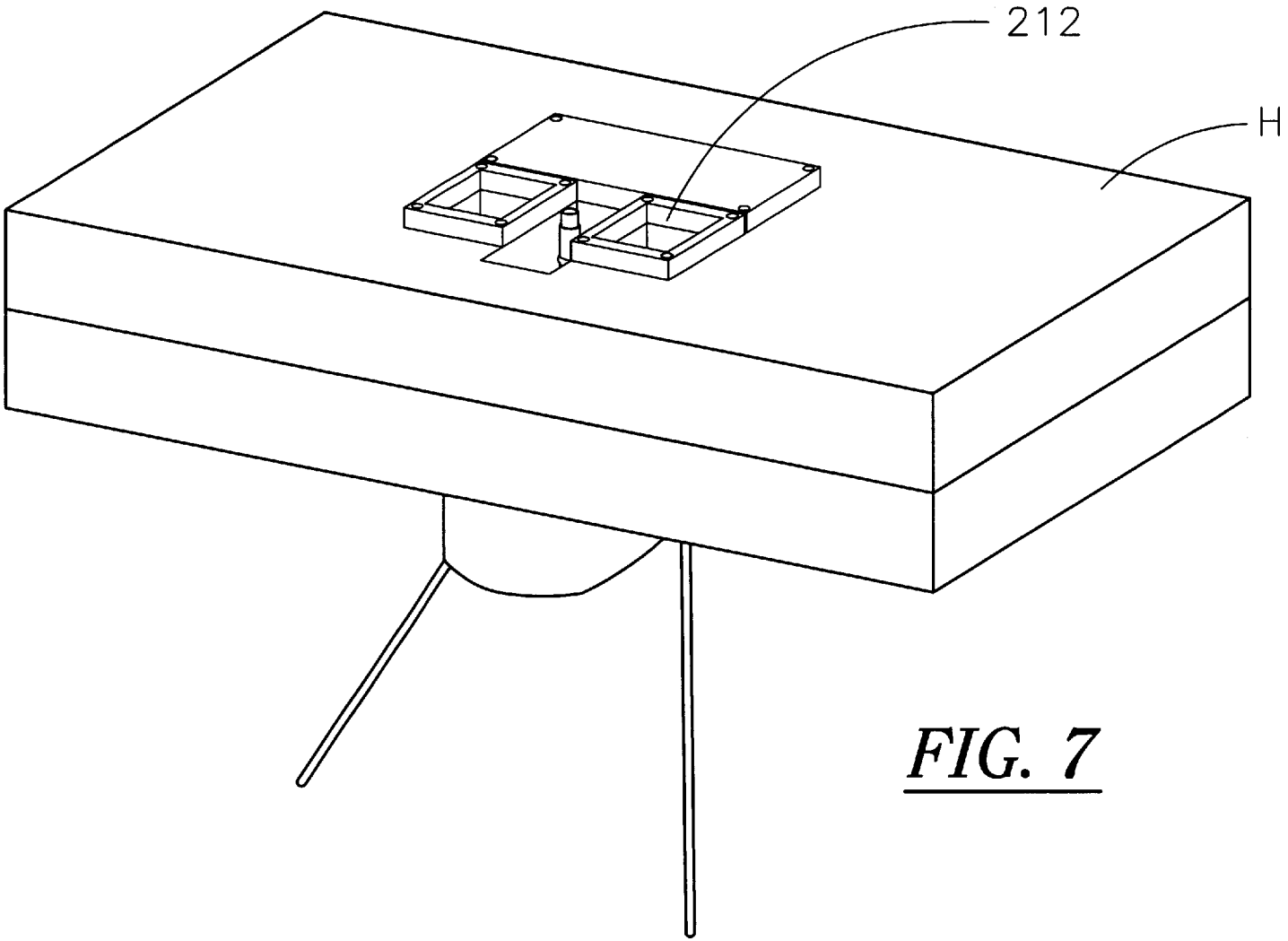
FIG. 7 is a schematic perspective of the valve seat of the present invention inserted in a cylinder head.

FIG. 7 shows that the valve seats 212 may be machined flat into the cylinder head H, which no longer needs to be domed.

The present invention may be embodied in other specific forms without departing from the spirit or essential attributes thereof. It is therefore desired that the present embodiment be considered in all respects as illustrative and not restrictive, reference being made to the appended claims rather than to the foregoing description to indicate the scope of the invention.

What is claimed:

1. A valve assembly for limiting a fluid flow into and out of a chamber, comprising:

a) a valve seat in a wall of the chamber, wherein fluid flows into and out of the chamber through the valve seat;

b) a valve face engaging the valve seat, wherein the valve face is external to the chamber, with the valve face rotatable about an axis of rotation and being nonconcentric to the axis of rotation; and c) means rotating the valve face about the axis of rotation for moving the valve face toward and away from the valve seat wherein the valve face is substantially removed from the path of fluid flow through the valve seat when the valve face is moved away from the valve seat.

2. A valve assembly for an internal combustion engine, the internal combustion engine having a cylinder and a cylinder head, air entering into the cylinder through the valve assembly and exhaust gases exiting the cylinder through the valve assembly, the valve assembly comprising:

a) a valve seat in the cylinder head;

b) a valve face engaging the valve seat, the valve face being external to the cylinder head, with the valve face rotatable about an axis of rotation and being nonconcentric to the axis of rotation; and c) means rotating the valve face about the axis of rotation for moving the valve face toward and away from the valve seat.

3. The valve assembly of claim 2, wherein the valve seat has a first axis therethrough, the valve face has an arcuate portion having a second axis substantially normal to the first axis, with the second axis moving toward and away from the first axis during rotation of the valve face about the axis of rotation, with the arcuate portion engaging the valve seat.

4. The valve assembly of claim 3, wherein the valve face further comprises a wedge-shaped portion having the arcuate portion.

5. The valve assembly of claim 4, further comprising an elongate portion attached to the wedge-shaped portion opposite the arcuate portion and parallel to the second axis; and first and second sides extending parallel to the elongate portion and between the elongate portion and opposite side edges of the arcuate portion and wherein the means for moving the valve face engages the elongate portion and causes rotation of the elongate portion about the axis of rotation therethrough.

6. The valve assembly of claim 2, wherein the means for moving the valve face comprises an elongate portion connected to the valve face, with the elongate portion defining the axis of rotation of the valve face for moving the valve face toward and away from the valve seat; a rocker arm extending radially from the elongate portion; a moving push rod engaging the rocker arm and connected to a camshaft; and a spring engaging the rocker arm and opposing a motion of the push rod, with engagement of the camshaft driving the moving push rod to rotate the elongate portion to rotate the valve face about the axis of rotation, with the spring engaging the rocker arm opposite the moving push rod.

7. The valve assembly of claim 2, wherein the means for moving the valve face comprises an elongate portion connected to the valve face, with the elongate portion defining the axis of rotation of the valve face for moving the valve face toward and away from the valve seat; a moving rocker arm extending radially from the elongate portion and connected to a camshaft; and a spring engaging the rocker arm and opposing a motion of the rocker arm, with engagement of the camshaft driving the moving rocker arm to rotate the elongate portion to rotate the valve face about the axis of rotation, with the spring engaging the rocker arm opposite the camshaft.

8. A valve assembly for an internal combustion engine, the internal combustion engine having a cylinder and a cylinder head, air entering into the cylinder through the valve assembly and exhaust gases exiting the cylinder through the valve assembly, the valve assembly comprising:

a) a valve seat in the cylinder head;

b) a valve face engaging the valve seat, the valve face being external to the cylinder head; and c) means for moving the valve face toward and away from the valve seat, wherein the valve seat has a first axis therethrough, the valve face has a second axis therethrough substantially normal to the first axis, wherein the valve face rotates about an axis of rotation to move the second axis toward and away from the first axis, with the second axis being spaced from and parallel to the axis of rotation.

9. The valve assembly of claim 8, wherein the means for moving the valve face comprises an elongate portion connected to the valve face, with the elongate portion defining the axis of rotation of the valve face for moving the valve face toward and away from the valve seat; a rocker arm extending radially from the elongate portion; a moving push rod engaging the rocker arm and connected to a camshaft; and a spring engaging the rocker arm and opposing a motion of the push rod, with engagement of the camshaft driving the moving push rod to rotate the elongate portion to rotate the valve face about the axis of rotation, with the spring engaging the rocker arm opposite the moving push rod.

10. The valve assembly of claim 8, wherein the means for moving the valve face comprises an elongate portion connected to the valve face, with the elongate portion defining the axis of rotation of the valve face for moving the valve face toward and away from the valve seat; a moving rocker arm extending radially from the elongate portion and connected to a camshaft; and a spring engaging the rocker arm and opposing a motion of the rocker arm, with engagement of the camshaft driving the moving rocker arm to rotate the elongate portion to rotate the valve face about the axis of rotation, with the spring engaging the rocker arm opposite the camshaft.

11. The valve assembly of claim 8, wherein the valve face further comprises a wedge-shaped portion having an arcuate portion having the second axis, wherein the arcuate portion engages the valve seat.

12. The valve assembly of claim 11, further comprising an elongate portion attached to the wedge-shaped portion opposite the arcuate portion and parallel to the second axis; and first and second sides extending parallel to the elongate portion and between the elongate portion and opposite side edges of the arcuate portion and wherein the means for moving the valve face engages the elongate portion and causes rotation of the elongate portion about the axis of rotation therethrough.

13. A valve assembly for limiting a fluid flow between the inside and outside of a chamber, the valve assembly comprising, in combination:

a) a valve seat in a wall of the chamber, the valve seat providing for fluid flow between the inside and outside of the chamber; and b) a valve face mounted outside of the chamber and having an engaging portion rotatably mounted about an axis of rotation to move between an engaged position and a disengaged position with respect to the valve seat, with the engaging portion being arcuate and having a valve face axis parallel to and spaced from the axis of rotation and the valve face forming a seal with the valve seat in the engaged position, with the valve face being nonconcentric to the axis of rotation, with the valve face axis moving toward and away from the valve seat when the valve face rotates about the axis of rotation.

14. The valve assembly of claim 13 with the valve seat having a first axis parallel to the fluid flow through the valve seat and with the engaging portion in the disengaged position being removed from the first axis parallel to the fluid flow through the valve seat, thereby minimizing turbulence inside the chamber and reducing obstruction to the fluid flow.

15. The valve assembly of claim 13 with the engaging portion forming a seal outside of the chamber in the engaged position.

16. The valve assembly of claim 13 with the chamber further comprising, in combination: a cylinder and a cylinder head of an internal combustion engine and with the valve seat set in the cylinder head.

17. The valve assembly of claim 13 with the valve face rotating about the axis of rotation to move the engaging portion between the engaged position and the disengaged position, with the engaging portion having the same radial spacing from the axis of rotation in the engaged position and the disengaged position.

18. The valve assembly of claim 13, further comprising, in combination: an elongate portion connected to the valve face, with the elongate portion defining the axis of rotation of the valve face for moving the engaging portion between the engaged position and the disengaged position; a rocker arm extending radially from the elongate portion; a moving push rod engaging the rocker arm and connected to a camshaft; and a spring engaging the rocker arm and opposing motion of the moving push rod, with engagement of the camshaft driving the moving push rod to rotate the elongate portion to rotate the valve face about the axis of rotation, with the spring engaging the rocker arm opposite the moving push rod.

19. The valve assembly of claim 13, with the valve face comprising a wedge-shaped portion formed by an elongate portion coaxial with the axis of rotation; and first and second sides extending parallel to the axis of rotation and between the elongate portion and opposite side edges of the engaging portion.

20. The valve assembly of claim 13, with the engaging portion having a location at the disengaged position substantially removed from the fluid flow to minimize creation of a void from fluid flow over the engaging portion.

21. A valve assembly for limiting fluid flow into and out of a chamber, the valve assembly comprising, in combination:

a) a valve seat in a wall of the chamber, the valve seat providing for fluid flow between the inside and outside of the chamber; and b) a valve face having an arcuate engaging portion and mounted to rotate on a single axis of rotation between an engaged position and disengaged position, with the arcuate engaging portion having a valve face axis parallel to and spaced from the axis of rotation and engaging the valve seat to form a seal in the engaged position, with the arcuate engaging portion of the valve face being nonconcentric to the single axis of rotation, with the valve face axis moving toward and away from the valve seat when the valve face rotates about the single axis of rotation.

* * * * *